US005988939A

United States Patent [19]

Allen et al.

[11] Patent Number: 5,988,939

[45] Date of Patent: Nov. 23, 1999

[54] UNIVERSAL BRIDGE DECK VIBRATING SYSTEM

[75] Inventors: J. Dewayne Allen, Paragould, Ark.; Michael W. McKean, Arlington, Tenn.

[73] Assignee: Allen Engineering Corp., Paragould, Ark.

[21] Appl. No.: 08/884,064

[22] Filed: Jun. 27, 1997

[51] Int. Cl.[6] ..... E01C 19/38

[52] U.S. Cl. ..... 404/116; 404/115; 404/113; 404/84.05

[58] Field of Search ..... 404/115, 113, 404/119, 72, 116, 74; 474/74, 84, 85, 88, 89

[56] References Cited

U.S. PATENT DOCUMENTS

| | | | |
|---|---|---|---|
| 1,747,555 | 2/1930 | Pelton . | |
| 1,898,158 | 2/1933 | Winkler . | |
| 2,030,315 | 2/1936 | Noble | 94/44 |
| 2,148,214 | 2/1939 | Mall | 94/48 |
| 2,223,734 | 12/1940 | Mall | 94/48 |
| 2,233,833 | 3/1941 | Jackson | 94/48 |
| 2,248,103 | 7/1941 | Mall | 94/48 |
| 2,261,659 | 11/1941 | Pierce | 94/48 |
| 2,292,733 | 8/1942 | Baily | 94/48 |
| 2,380,435 | 7/1945 | Heltzel | 94/46 |
| 2,382,096 | 8/1945 | Pierce | 94/45 |
| 2,461,500 | 2/1949 | Miller et al. | 94/48 |
| 2,583,108 | 1/1952 | Lewis | 94/44 |
| 3,042,386 | 7/1962 | Wyzenbeek | 259/1 |

(List continued on next page.)

OTHER PUBLICATIONS

Bid–Well publication "job report", author and dates unknown.

Bid–Well publication, Model VB–75 author and dates unknown.

Bid–Well publication Concrete Pavers Catalog author & date Unknown.

Gomaco Publication C–700 Cylinder Finisher author & dates unknown.

EXEN publication VBH73EH; VBH74EH; VBH75EH author: EXEN Corporation Pub. Date: Mar. 19, 1996.

ISKCO, Ltd. publication Handy–VIB author: unknow publication date: unknown.

*Primary Examiner*—Thomas B. Will
*Assistant Examiner*—Raymond W Addie
*Attorney, Agent, or Firm*—Stephen D. Carver

[57] ABSTRACT

A vibration system that fits on top of a conventional truss with minimal alteration. The system comprises a propulsion assembly powering a vibration assembly. The propulsion assembly comprises two parallel rails forming a lateral path between truss ends and supporting a mobile carriage. Each rail comprises abutting segments coextensively surmounting the truss. Each segment attaches at respective truss cross-beams to define a continuous runway for carriage movement. Each segment also defines a channel for a chain rack anchored at opposite truss ends. The carriage comprises an undercarriage supporting an offset platform. The undercarriage comprises a rail-spanning frame with supporting runway tracking wheels. A motor propels the carriage by turning an axle with terminal pinions entrained about the rack. The offset counterbalances the vibration assembly to reduce torsion. A coupling hitch protrudes from the platform opposite the offset to support the vibration assembly. The vibration assembly comprises an elevator that vertically displaces a gang of vibrators between deployed and retracted positions. The elevator comprises a hydraulic cylinder coaxially centered between two sleeves with sliding arms that couple the gang to the elevator. The gang comprises a plurality of quick-coupling pendulous vibrators across the truss front. A motor drives multiple vibrators via a split axle connected to several gearboxes in series. When deployed, the vibrator tip thrusts into the concrete and undulates rapidly for a selected time. Afterwards, the vibrators retract and the carriage moves to an adjacent vibrated sector of concrete until completely traversing the truss. They system may operate automatically or manually.

3 Claims, 9 Drawing Sheets

U.S. PATENT DOCUMENTS

| | | | |
|---|---|---|---|
| 3,110,234 | 11/1963 | Oster | 94/45 |
| 3,113,494 | 12/1963 | Barnes | 94/45 |
| 3,180,625 | 4/1965 | Wynzenbeek | 259/1 |
| 3,188,054 | 6/1965 | Mason, Jr. | 259/1 |
| 3,299,786 | 1/1967 | Godbersen | 94/45 |
| 3,377,933 | 4/1968 | Dale | 94/45 |
| 3,450,011 | 6/1969 | Godbersen | 94/45 |
| 3,541,931 | 11/1970 | Godbersen | 94/45 |
| 3,555,983 | 1/1971 | Swisher et al. | 94/46 |
| 3,593,627 | 7/1971 | Rowe et al. | 94/45 |
| 3,596,565 | 8/1971 | Atkinson | 91/411 R |
| 3,738,763 | 6/1973 | Glesmann | 404/119 |
| 3,753,621 | 8/1973 | Dale | 404/116 |
| 4,128,359 | 12/1978 | Cooper, Jr. et al. | 404/72 |
| 4,249,327 | 2/1981 | Allen | 404/114 |
| 4,256,415 | 3/1981 | Rowe et al. | 404/116 |
| 4,314,773 | 2/1982 | Allen | 404/116 |
| 4,320,987 | 3/1982 | Rowe et al. | 404/115 |
| 4,446,784 | 5/1984 | Gurak et al. | 474/231 |
| 4,484,834 | 11/1984 | Rowe et al. | 404/84 |
| 4,572,704 | 2/1986 | Allen | 404/114 |
| 4,577,993 | 3/1986 | Allen et al. | 404/112 |
| 4,621,375 | 11/1986 | Simnovec | 455/603 |
| 4,708,520 | 11/1987 | Rowe | 404/115 |
| 4,775,262 | 10/1988 | Guntharp et al. | 404/103 |
| 5,108,220 | 4/1992 | Allen et al. | 404/112 |
| 5,480,257 | 1/1996 | Allen | 404/112 |
| 5,480,258 | 1/1996 | Allen | 404/112 |
| 5,492,432 | 2/1996 | Eben et al. | 404/115 |
| 5,690,567 | 11/1997 | DeNijs et al. | 474/73 |

UNIVERSAL BRIDGE DECK VIBRATING SYSTEM

BACKGROUND OF THE INVENTION

I. Field of the Invention

The present invention relates generally to finishing machines for bridges. More particularly, the present invention relates to an universal vibration system for a bridge deck finishing machine. Known prior art may be found in U.S. Class 404, subclass 16 and the other various subclasses listed thereunder.

II. Description of the Prior Art

It is well-known that plastic concrete should be vibrated to densify and consolidate it during finishing to produce desirable results. The prior art includes a wide variety of vibration devices for settling and densifying plastic concrete. Several of these devices have been used with bridge decks to vibrate the plastic concrete thereon. Most of these bridge deck devices can be grouped as either single portable vibrators or truss-mounted gangs of multiple vibrators.

The portable vibrators permit an operator to vibrate a small area of concrete prior-to other finishing operations. The portable units generally comprise a power supply coupled to an elongated flexible pendulous vibrator. The operator generally transports the power unit on their back while thrusting the vibrator into the concrete. Unfortunately, these units require several operators to effectively vibrate large sectors of concrete. Also, they require experienced operators if the results are to be satisfactorily uniform. This lack of uniformity is undesirable because it often leads to sections of unconsolidated or otherwise weakened concrete. Consequently, automatic gangs of vibrators are often specified to be employed with large concrete pours to ensure satisfactory uniformity.

Several known prior art devices have been proposed to satisfy the need for an efficient bridge deck vibrating system. For example, a company named Bid-Well located in Canton, S. Dak., produces different types of bridge deck trusses. However, most of their vibrating gangs require specialized bridge deck trusses that are unduly complicated to employ for a number of reasons discussed hereinafter. One recently introduced machine mounts on the front of their proprietary bridge deck truss to alleviate some of the problems with their other specialized vibrating trusses. However, this machine does not readily retrofit other, non-proprietary bridge deck trusses commonly employed in the construction industry. Moreover, it is not a stand alone unit in that it requires a sizable remote power supply with accompanying cumbersome transfer cabling and constant operator supervision. It also exerts torsion on the truss that could adversely affect finishing operations.

It is believed that Bid-Well (or a related corporation named CMI located in Oklahoma City, Okla.) owns several patents of general relevance to the present invention. These patents include U.S. Pat. Nos. 3,738,763, 3,593,627, 4,484,834, 5,492,432, 4,256,415, 4,320,987, 4,708,520 and 4,775,262.

Other known relevant art includes U.S. Pat. No. 4,128,359. This patent shows a self-propelled concrete vibrator apparatus which includes a plurality of hydraulically powered vibrators positioned at evenly spaced apart intervals across the full width of a support truss. This device includes a plurality of hydraulic rams which raise and lower the plurality of vibrator units into and out of a mass of wet concrete. A second group of horizontally oriented hydraulic rams is coupled to the plurality of vibrator units and laterally displaces the vibrator units between a first and a second position. This device includes a hydraulic pump driven by an internal combustion engine and a plurality of four drive units for longitudinally translating the entire structure along the length of the concrete to be vibrated.

U.S. Pat. No. 2,223,734 discloses a concrete vibrator which is longitudinally translatable along the length of an area of wet concrete. This device includes a vibrator carriage that is longitudinally translatable between a first and a second position. The carriage also includes a centrally mounted shaft that permits it to pivot and thereby partially elevate the mechanically driven concrete vibrators with respect to the surface of the wet concrete.

U.S. Pat. No. 2,248,103 discloses an attachment for a screed which includes a laterally oriented frame having a plurality of evenly spaced apart vibrators. A and actuated lever permits an operator to simultaneously raise or lower all of the vibrators with respect to the surface of the wet concrete.

U.S. Pat. No. 2,382,096 discloses a paving machine having a plurality of vibrator units mounted at fixed positions laterally across the face of the device. The vibrators span the entire width of the wet concrete surface to be vibrated. This device includes a concrete screed and it is hydraulically powered. The plurality of vibrators are pivoted about a point and inserted at an angle into the wet concrete in a manner that permits the vibrators to travel beneath the concrete screed.

U.S. Pat. No. 2,292,733 discloses a concrete vibrating device including a plurality of vibrators mounted at a fixed position along the entire width of the device. The vibrators are flexibly coupled to the frame, thus permitting them to be deflected to the rear of the frame as it advances through the concrete.

U.S. Pat. No. 2,461,500 discloses and apparatus for compacting concrete slabs that includes a plurality of vibrator units mounted at fixed positions laterally across the device. Each vibrator is driven by a motor coupled to a flexible shaft. The vibrators trail behind and penetrate below the surface of the wet concrete as the device advances through the concrete.

U.S. Pat. No. 2,148,214 discloses a vibrating machine that includes an inverted "T"-shaped horizontally oriented vibrating tube that is immersed into the wet concrete. U.S. Pat. No. 2,233,833 discloses a related device having three horizontally oriented vibrating tubes that vibrate the wet concrete. A screed is also used to level the surface of the wet concrete.

U.S. Pat. No. 3,555,983 discloses a paving grout control device that includes vibrator units positioned at evenly spaced intervals laterally across the front of the device. This device includes a comb-like structure that is immersed at a point behind the vibrating units at a predetermined depth into the paving material.

U.S. Pat. No. 3,113,494 discloses a machine for finishing concrete surfaces that includes a mechanically vibrated screed. This device is laterally translated by a pair of manually operated winches, one of which is coupled to each end of the frame.

Other known patents of lesser relevance include U.S. Pat. Nos. 1,747,555, 2,030,315, 1,898,158, 3,413,902, 3,042,386, 3,180,625, 3,188,054, 2,261,659, 2,380,435, 2,583,108, 3,110,234, 3,377,933, 3,753,621, 3,299,786, 3,450,011 and 3,541,931.

Other patents owned by the assignee of this invention include U.S. Pat. Nos. 5,108,220, 5,480,257, 5,480,258, 4,577,993, 4,249,327, 4572,704 and 4,314,773, as well as others. Of the former, U.S. Pat. Nos. 4,572,704 and 4,314,773 are the most relevant to the present invention and their disclosures are hereby expressly incorporated by reference herein. They both discloses bridge deck machines that are capable of vibrating plastic concrete with gang vibrators. However, they may not be easily retrofitted to other conventional bridge deck trusses nor can they be used as stand alone vibratory gangs.

The known prior art fails to adequately address the need for all easily retrofittable gang vibration system for conventional bridge deck trusses. A conventional truss comprises several independent sections that are typically coupled together at the construction site. Since the sections are commonly available in 8, 10 and 12 foot lengths, the overall width of a particular truss may thus be adapted to satisfy varying operational parameters.

The conventional truss also employs a pair of spaced apart end stanchions that support it above the bridge or other work area. Generally, the stanchions are coupled to the exterior truss sections and they are nominally equipped with motorized wheels that move the truss. Normally, the wheels ride on a pair of spaced apart tubes that typically bound the construction site longitudinally. Thus, as the truss traverses the tubes, work is performed on the area underneath and adjacent to the truss.

However, the known prior art devices generally require specialized unitary bridge deck trusses that cannot be assembled on site in appropriate lengths to satisfy varying operational parameters. As such, they are generally undesirable. These devices also lack adaptability and they typically demand excessive prior planning to ensure their availability and workability at the Construction site. Furthermore, they also cause logistical problems that are difficult to resolve.

An improved vibration system should be installable on a conventional bridge deck truss with minimal truss alteration. Preferably, the system should be self sufficient and it should be able to operationally stand-alone without needing truss supplied power. A particularly desirable system would have guidance and location controls that enabled it to operate with minimal operator supervision or direction.

SUMMARY OF THE INVENTION

Our invention overcomes the above perceived problems associated with the known prior art. The present invention comprises a vibration system that fits on the top of a conventional finishing truss of the type used to finish bridge decks and the like with minimal truss alteration.

The system comprises a propulsion assembly that supports and powers a vibration assembly. Preferably, the propulsion assembly laterally traverses the entire truss top during use. In the preferred embodiment, the vibration assembly vibrates the plastic concrete adjacent the truss front to consolidate and densify it. However, other types of assemblies could be used with the propulsion assembly to otherwise finish or work with the plastic concrete.

The propulsion assembly comprises a pair of spaced apart rails that support a mobile carriage. The rails cooperatively form a lengthwise or lateral path across the truss top between opposite truss ends. The carriage traverses the path between the ends during concrete finishing. Preferably, the carriage is self-propelled and radio controlled so that the system call be manipulated by a remote operator.

Each rail comprises a plurality of elongated segments coextensively surmounting the entire length of the truss. Each rail segment abuts an adjacent segment so that each rail is continuous. Each segment end is anchored to each section cross-beam by a mounting bracket with conventional nuts and bolts. Thus, the rails may be easily and quickly installed on top of a conventional truss With minimal alterations. Each rail segment defines an exterior runway that establishes a route for carriage movement along each rail. Each segment also defines an interior channel that houses a channel that functions as a rack during carriage movement.

The carriage comprises an undercarriage supporting an upper platform. The undercarriage comprises a rigid parallelepiped frame that spans the rails. Several wheels secured to the bottom of the frame by elongated tabs support the frame above the rails. Preferably, at least two wheels ride in each runway to maintain carriage orientation and alignment during movement.

Preferably, a hydraulic motor selectively propels the carriage. The motor turns a sprocketed drive axle extending between the front and back of the frame while a rotary transducer adjacent the motor tracks carriage movement. Each end of the axle is supported by pillow bearings in plates adjacent terminal drive pinions. Each chain or linked rack is entrained about a drive pinion and a pair of idler sprockets. Thus, as the drive axle is turned by the motor, the rack is drawn through the pinion and idler sprockets to propel the carriage along the rails.

The upper platform mounts directly on top of the undercarriage frame. In the preferred embodiment, the upper platform extends rearwardly past the undercarriage frame to form an offset. The offset counterbalances the vibration assembly to reduce torsional stresses and/or strains caused thereby. The upper platform supports an internal combustion engine and its accessories, a generator, a control panel, a hydraulic fluid reservoir and a hydraulic pump.

In use, the engine powers the system by driving the hydraulic pump to provide pressurized fluids to the hydraulic drive motor and vibration assembly. Preferably, some of these components are placed in the offset area to counterbalance the vibration assembly. Of course, additional weights could be added to increase the effective counterbalance produced in the offset region to further reduce the torsion produced by the vibration assembly if desirable.

A coupling hitch protrudes forwardly from the platform opposite the offset. The hitch comprises a yoke secured to the platform and a receiver secured to the vibration assembly. Preferably, the yoke quick-couples to the receiver to secure the vibration assembly to the propulsion assembly.

The vibration assembly comprises an elevator that vertically displaces a gang of vibrators between a deployed position and a retracted position. The elevator comprises a superstructure secured to the receiver. A hydraulic cylinder between two hollow sleeves with telescoping arms is housed in the superstructure. A plate secured by the arms and the cylinder connects the gang of vibrators to the elevator.

A plate mounted guidance tab and the sleeved arms ensure that the gang of vibrators remains aligned with the elevator during deployment and retraction.

The gang of vibrators are supported by an elongated frame that is spaced apart from and parallel to the truss front. The frame supports a plurality of elongated pendulous vibrators that descend downwardly therefrom. When actuated, these pendulous vibrators rapidly undulate in the plastic concrete to consolidate and density it. While the pendulous vibrators may be driven by any conventional method, a particularly efficient configuration is to use a hydraulic motor to drive a split axle that drives multiple pendulous vibrators via individual vibrator gearboxes. Of course, other configurations with differing numbers of motors, axles, gearboxes and pendulous vibrators are possible and intended to be within the scope of this disclosure.

When deploying the pendulous vibrators, the tip of each pendulous vibrator is thrust into the concrete. When at a suitable depth, the vibrators are rapidly shaken for a predetermined time period until the concrete is suitably densified and consolidated.

Preferably, the pendulous vibrators are arranged in two rows of one foot square centers. In other words, the pendulous vibrators are one foot apart from each other front-to-back and side-to-side. Moreover, the back row of pendulous vibrators are preferably at least one foot in front of the truss.

Once a current sector of concrete is vibrated, the pendulous vibrators are retracted and the carriage moved to an adjacent unvibrated sector of concrete. When the carriage has completely traversed the truss from end to end, the truss moves longitudinally along the pour site to begin work upon a new length of concrete.

Thus, an object of the invention is to provide a retrofittable vibration system that may be easily installed on a conventional bridge deck truss with minimal truss alteration.

Another basic object of the invention is to provide a system that is self-guiding and that requires minimal operator supervision or direction A primary object of the present invention is to advantageously employ a conventional bridge deck truss with a vibrating assembly to consolidate and density plastic concrete at a construction site.

A related object of the present invention is to increase the efficiency and speed of finishing plastic concrete on bridge decks and the like.

Another object of the invention is to provide a vibration system that rides on top of a conventional truss.

A related object is to provide an outboard vibrating gang that minimizes torsion on the bridge deck truss.

A basic object of the present invention is to provide a gang vibration system that installs quickly on a conventional bridge deck truss.

Yet another object of the present invention is to provide a vibratory system that stands alone and does not require auxiliary power from the truss.

An object of the present invention is to provide a vibration system that does not require the use of truss mounted cabling for relaying operational signals.

These and other objects and advantages of the present invention, along with features of novelty apparent therewith, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
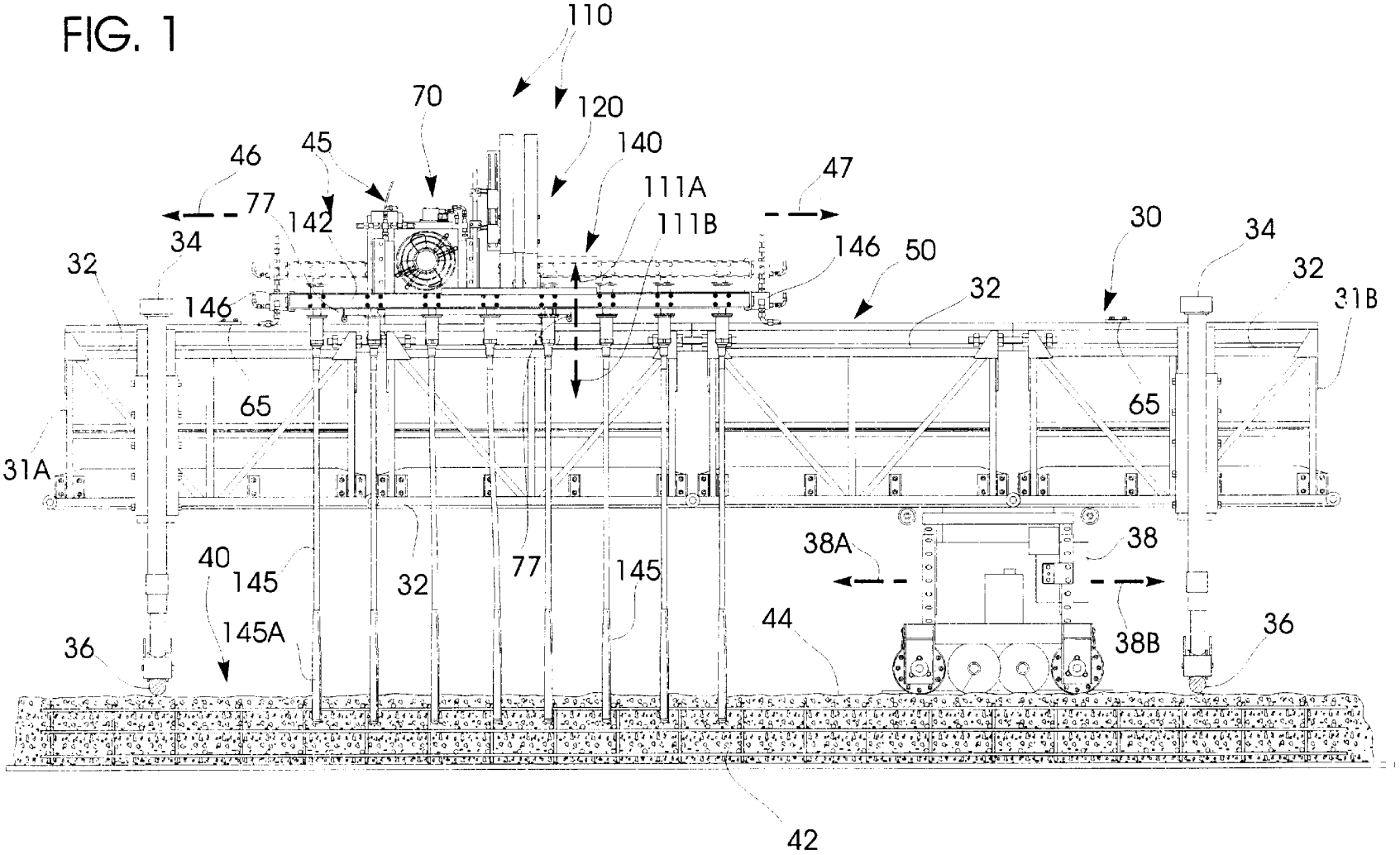
FIG. 1 is a front elevational view showing our Universal Bridge Deck Vibrating System installed on a conventional bridge deck truss and with the gang vibration assembly in the deployed position and the dashed lines showing the retracted position.
Figure 2:
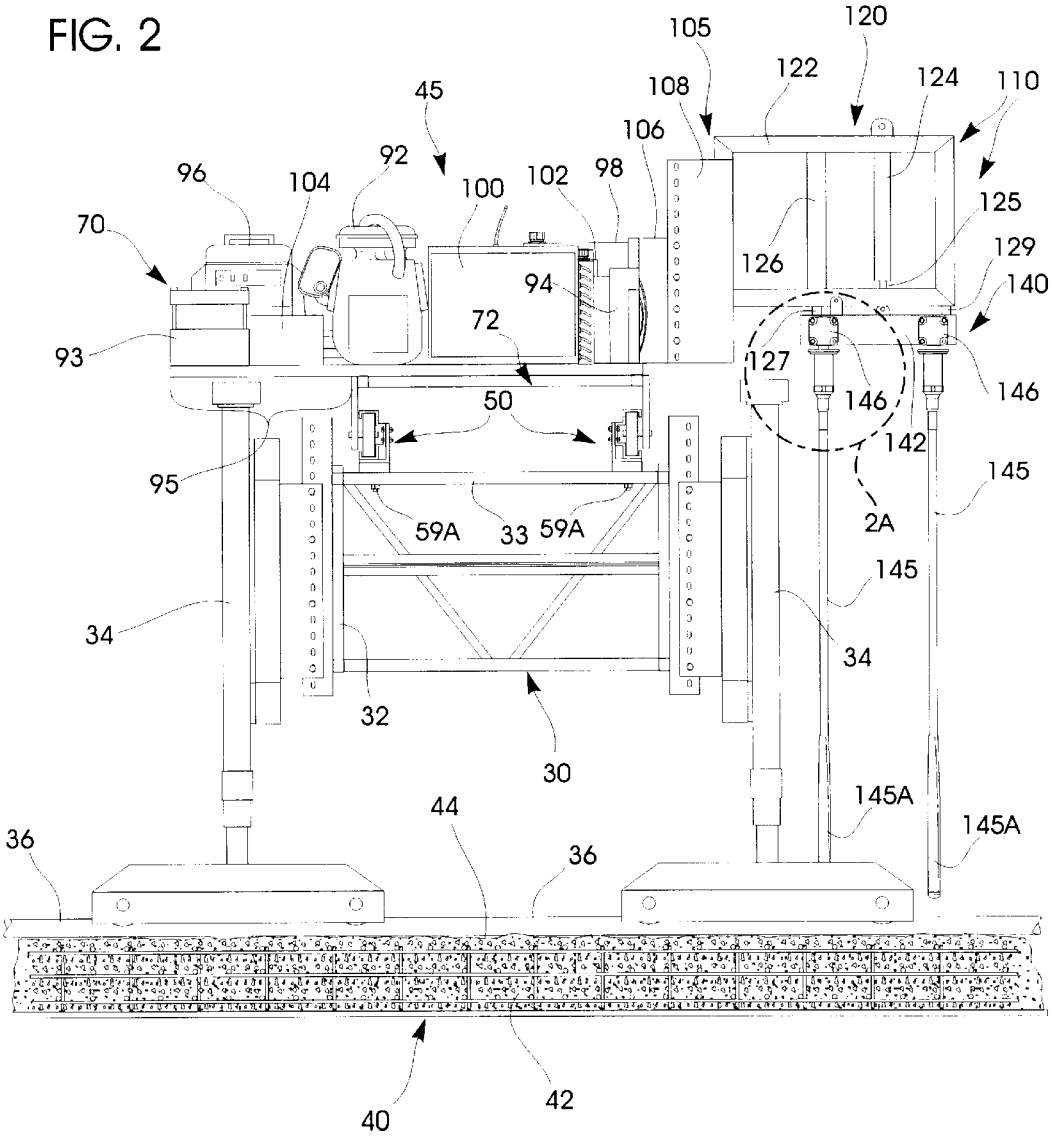
FIG. 2 is a partially fragmented side elevational view taken generally from the left side of FIG. 1, with portions omitted or broken away for clarity.
Figure 2A:
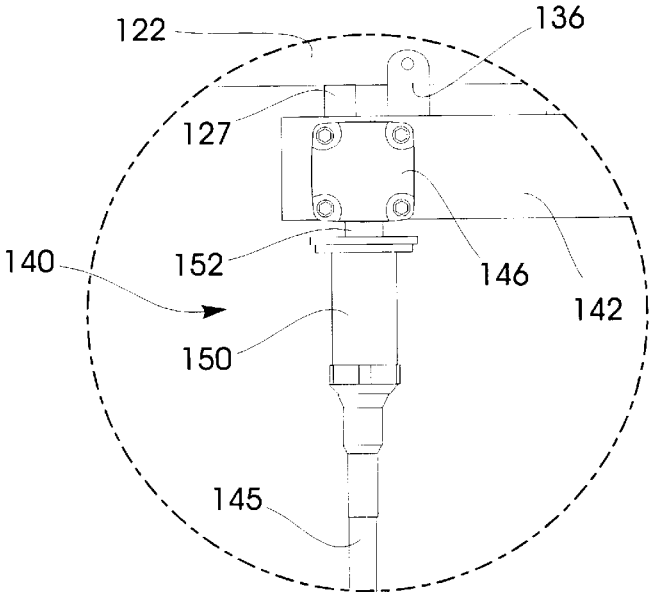
FIG. 2A is an enlarged view of the encircled portion of FIG. 2.
Figure 2B:
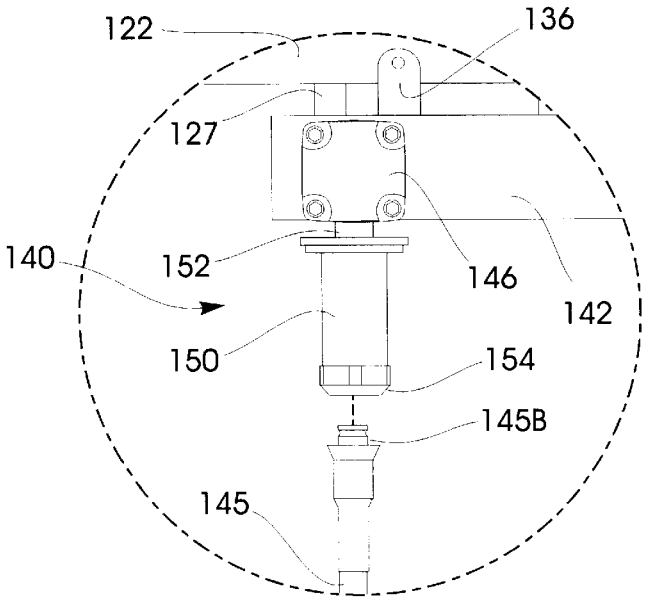
FIG. 2B is a partially exploded view of FIG. 2A.

Referring more specifically to the drawings, our improved bridge deck vibration system for conventional trusses is generally designated by reference numeral 25 in FIGS. 1–6. In the preferred embodiment, the vibration system 25 fits on the top of a conventional finishing truss 30 used to finish bridge decks and the like.

A conventional truss 30 comprises several independent sections 32 that are typically coupled together to form the truss 30 at the construction site. Since the sections 32 are commonly available 8, 10 and 12 foot lengths, the overall length of truss 30 may thus be adapted to satisfy on-site parameters. In other words, the truss 30 is usually configured to conform to the specific bridge or other structure under construction.

A conventional truss 30 also employs a pair of spaced apart end stanchions 34 to support it above a work area 44. Generally, the stanchions 34 are coupled to the outermost truss sections. The stanchions 34 are normally equipped with motorized wheels that move the truss 30 along a pair of spaced apart tubes 36 that typically bound the construction site 40 longitudinally. As the truss 30 traverses the tubes 36, a finishing paver 38 laterally traverses the work area 44 beneath the truss 30 to smooth and screed the plastic concrete 42 thereunder as indicated by arrows 20 38A, 38B in FIG. 1).

Our new vibration system 25 is adapted to be deployed on top of a conventional truss 30 with minimal truss alteration. The system 25 comprises a propulsion assembly 45 that supports and powers a vibration assembly 110.

Preferably, the vibration assembly 1 10 vibrates the unconsolidated plastic concrete 44 adjacent the front of the truss 30 prior to paver finishing. However, other types of assemblies could be used with propulsion assembly 45 to otherwise work on concrete 42.

The propulsion assembly 45 traverses the truss from one end 31A to the opposite end 31B during use (as indicated by arrows 46, 47 in FIG. 1). The propulsion assembly 45 comprises a pair of spaced apart rails 50 and a mobile carriage 70. The rails 50 cooperatively form a lengthwise or lateral path across the top of truss 30 extending from end 31A to end 31B. The rails 50 support a mobile carriage 70 that traverses the path between ends 31A, 31B. Preferably, carriage 70 is self-propelled and radio controlled so that the system 25 can be manipulated by a remote operator.

Figure 3:
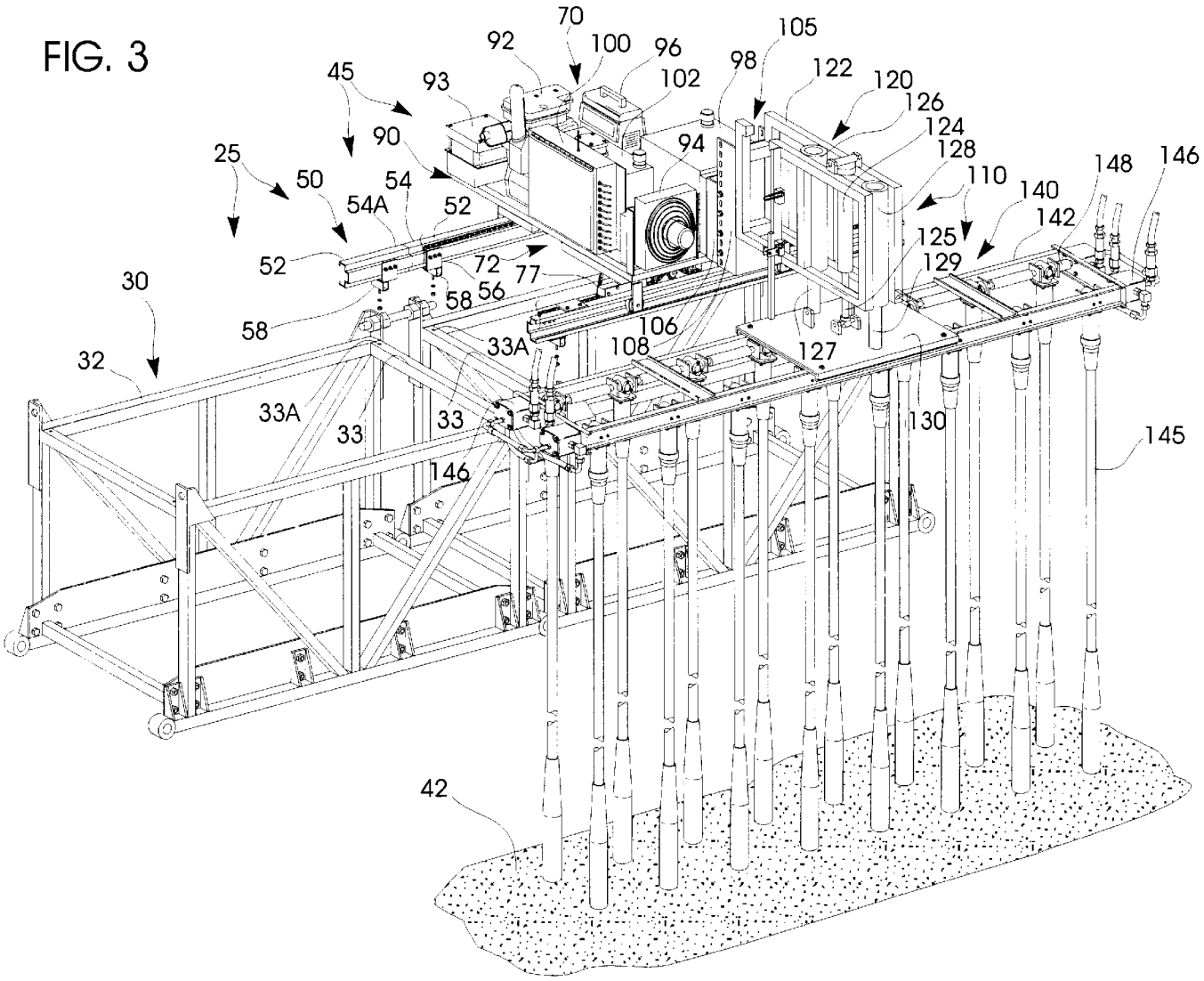
FIG. 3 is a partially exploded, fragmentary isometric view taken generally form the front and left of FIG. 1, with portions omitted or broken away for clarity.

Each rail 50 comprises a plurality of elongated segments 52 coextensively surmounting the entire length of truss 30 (FIGS. 1 and 3). Each rail segment 52 is placed on the top of an individual section cross-beam 33 so that each segment end 54 abuts an adjacent segment end 54A to make each rail 50 continuous from end 31A to end 31B (as best shown in FIGS. 1 and 3).

Figure 4:
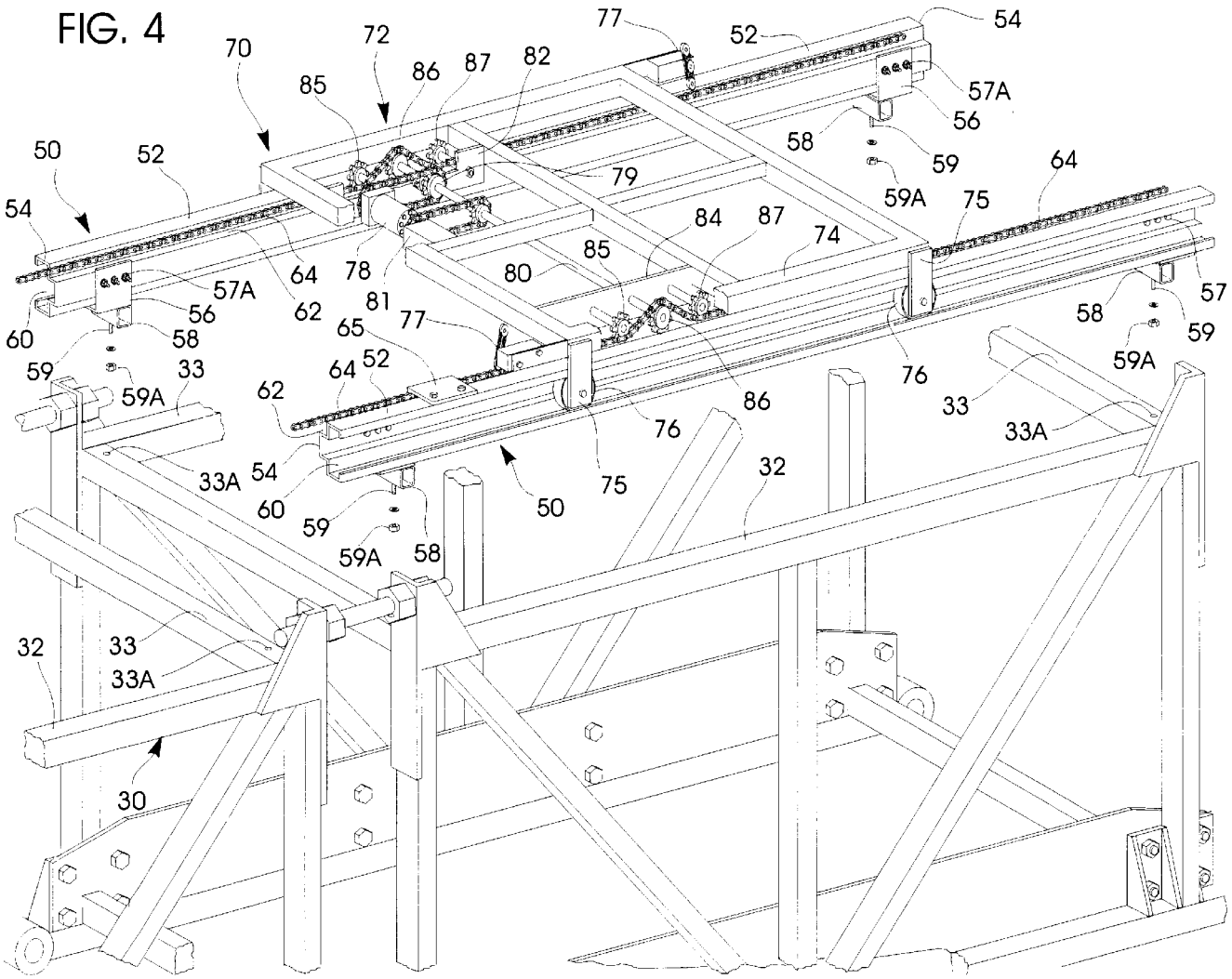
FIG. 4 is a partially exploded, fragmentary isometric view of the rails and undercarriage shown in FIG. 3, with portions omitted or broken away for clarity.
Figure 5:
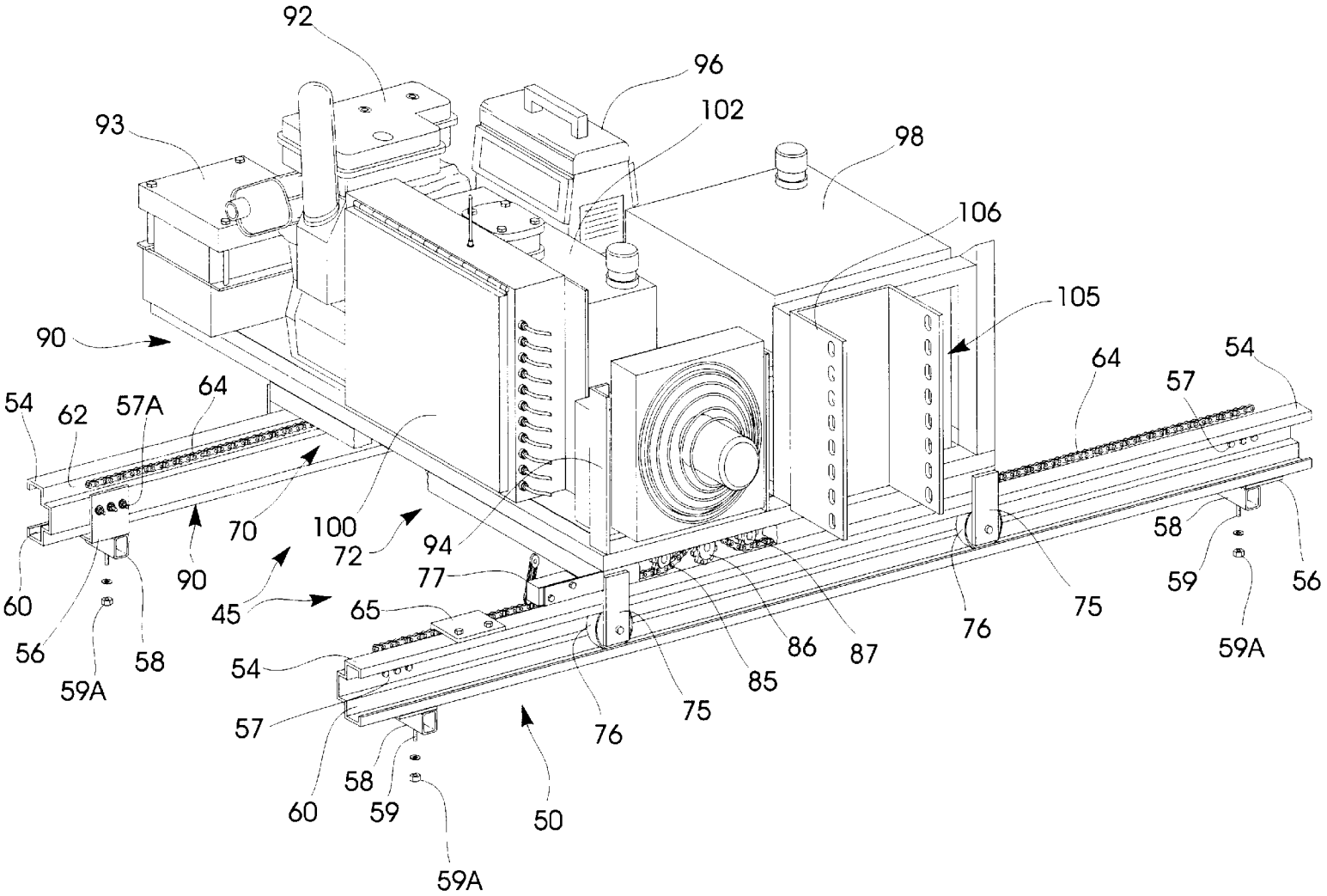
FIG. 5 is a partially exploded, fragmentary isometric view of the rails and carriage shown in FIG. 3, with portions omitted or broken away for clarity.
Figure 6:
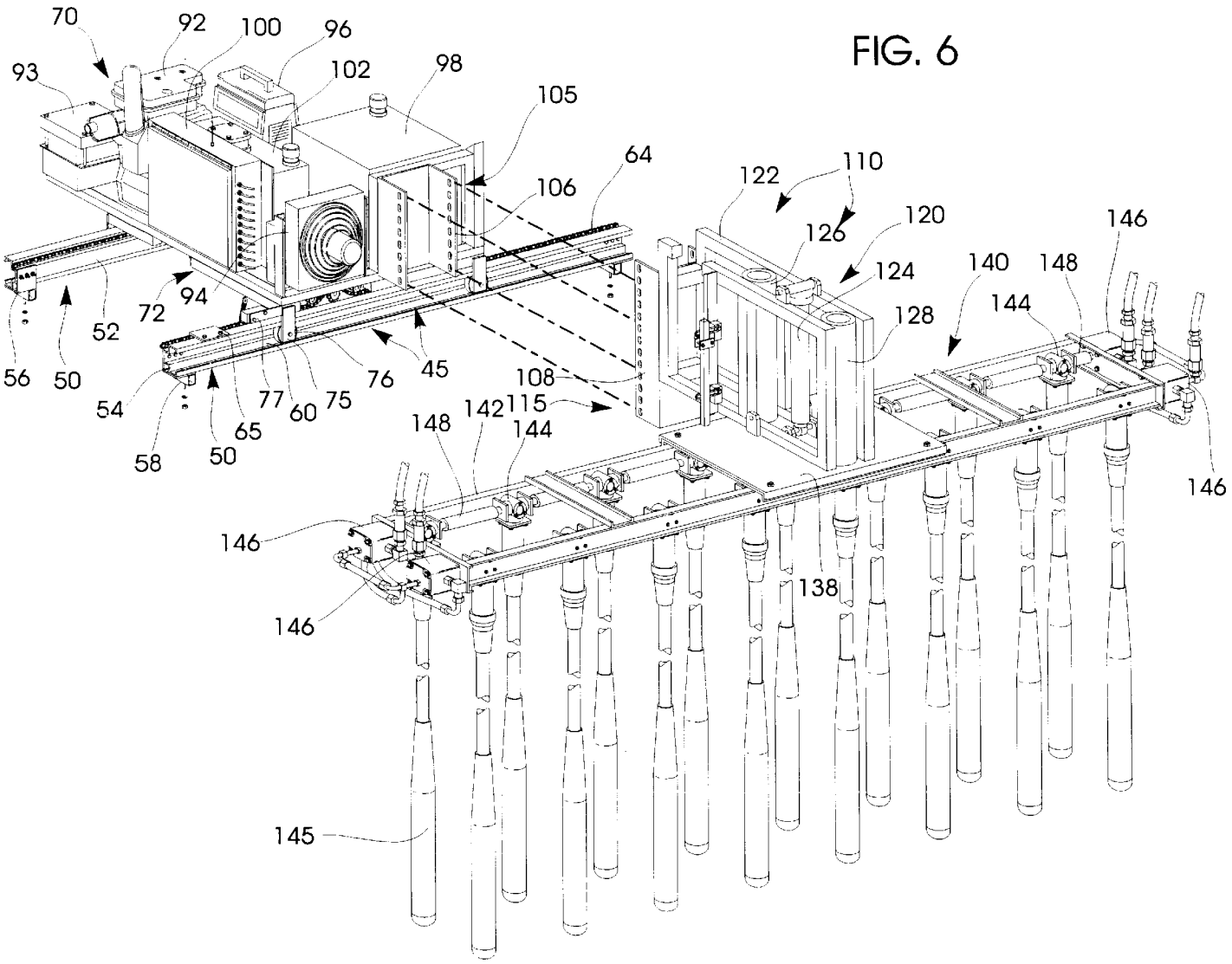
FIG. 6 is a partially exploded, fragmentary isometric view of the invention as shown in FIG. 3, showing the gang vibration assembly to carriage coupling with the gang assembly in the retracted position, with portions omitted or broken away for clarity.

Each segment 52 is anchored to each section 32 adjacent both segment ends 54 by a bracket 56. Bracket 56 is conventionally secured to each segment 52 adjacent each end 54 by bolts 57 and nuts 57A or in another conventional manner (FIGS. 3 and 4). Each bracket 56 comprises a transverse support 58 that installs on top of cross-member 33 through hole 33A via a threaded stud 59 and nut 59A or with other conventional methods. Thus, rails 50 may be easily and quickly installed on top of a conventional truss 30 with minimal alteration of the truss 30.

Each rail segment 52 defines an exterior runway 60 that establishes a route for carriage movement along each rail 50. Each segment 52 also defines an interior channel 62 that houses a linked rack 64. Rack 64 ensures that carriage 70 moves positively as it traverses the rails 50. Each rack 64 is secured adjacent the truss ends 31A, 31B by an anchoring bracket 65. Preferably, anchoring bracket 65 may be quickly coupled to the rail segments adjacent the interiors of stanchions 34.

Carriage 70 comprises an undercarriage 72 supporting an tipper platform 90. Undercarriage 72 comprises a rigid parallelepiped frame 74 that spans rails 50. Several wheels 76 are secured to the bottom of frame 74 by elongated tabs 75. Wheels 76 support frame 74 above the rails 50 and at least two wheels 76 ride in each runway 60 to maintain carriage orientation and alignment during movement.

Preferably, a hydraulic motor 78 selectively propels undercarriage 72. Motor 78 turns a sprocketed drive axle 80 via a drive chain 79. As carriage 70 approaches truss ends 31A or 31B, a travel limit switch 77 is tripped by bracket 65 to stop carriage movement. Drive axle 80 extends between the front and back of frame 74 and it is supported by pillow bearings in plates 82, 84 adjacent the front and back of frame 74.

The drive axle 80 turns a rotary transducer 81 as well as terminal drive pinions 86. The rotary transducer 81 sends information to the control panel, as is discussed more fully hereinafter. Each linked rack 64 is entrained about a drive pinion 86 and idler sprockets 85 and 87. Thus, as drive axle 80 is turned by motor 78, rack 64 is effectively pulled under sprockets 85 and 87 and over pinion 86 to positively move carriage 70 along rails 50.

The tipper platform 90 mounts directly on top of frame 74. In the preferred embodiment, the upper platform 90 extends rearwardly past frame 74 so that an offset 95 is established to counterbalance the vibration assembly 110. Upper platform 90 supports the engine 92, batteries 93, radiator 94, generator 96, hydraulic fluid reservoir 98, control panel 100, a manifold 102 and a hydraulic pump 104.

Preferably, the batteries 93, radiator 94 and pump 104 are placed in the offset area 95 to counterbalance a portion of the torsion produced by the weight of the vibration assembly II 0. Of course, additional weights could be added to increase the effective counterbalance produced in the offset 95 to further reduce the torsion produced by the vibration assembly 1 10 if desirable.

A coupling hitch 105 protrudes outwardly from the platform 90 opposite offset 95. The hitch 105 comprises a yoke 106 secured to platform 90 and a receiver 108 secured to the vibration assembly 110. Preferably, yoke 106 can be quick-coupled to receiver 108 via conventional nuts and bolts or in another suitable fashion. Thus, the propulsion system 45 supports the vibration assembly 110 in front of the truss 30 so that the plastic concrete 42 immediately adjacent the truss 30 may be consolidated and densified.

Vibration assembly 110 comprises an elevator 120 and a gang of vibrators 140. The elevator 120 vertically displaces the gang of vibrators 140 (as indicated by arrows 111A, 111B in FIG. 1) between a deployed position (shown in FIGS. 1 and 3) and a retracted position (shown in FIGS. 2 and 6).

The elevator 120 comprises a superstructure 122 secured to the receiver 108. The superstructure 122 captivates a hydraulic cylinder 124 between two hollow sleeves 126, 128. The sleeves 126, 128 receive guide arms 127, 129. When actuated, the ram 125 moves into or out of cylinder 124 to vertically displace the gang of vibrators 140. A pair of spaced apart electric quick-plug switches 130, 132 limit the travel of ram 125 between an uppermost and lowermost position via an elongated trip rod 134.

A guidance tab 136 along with sleeves 126, 128 and arms 127, 129 ensure that the gang of vibrators 140 remains aligned with the elevator 120. A plate 138 is secured by the arms 127, 129 and the cylinder ram 125 to the top of gang of vibrators 140 by bolts and nuts or the like to connect the elevator 120 to the gang 140.

The gang of vibrators 140 comprises an elongated frame 142 that is spaced apart from and parallel to the front of truss 30. The frame 142 suspends a plurality of elongated pendulous vibrators 145 that extend downwardly therefrom. When actuated, these pendulous vibrators 145 rapidly undulate in the plastic concrete 42, as will be discussed more fully hereinafter.

While the pendulous vibrators 145 may be driven by any conventional method, a particularly efficient configuration is to use a hydraulic motor 146 to drive a split output axle 148 that drives multiple pendulous vibrators 145 via individual pendulous vibrator gearboxes 144. Preferably the motors 146 and the elevator cylinder 124 all use hydraulic quick couplings to facilitate coupling of vibration assembly 110 to propulsion assembly 45.

The most efficient known drive alignment is to configure the pendulous vibrators 145 in banks of four per motor 146 and axle 148. In other words, a hydraulic motor 146 turns a split output axle 148 that intersects and drives four gearboxes 144 that each drive a pendulous vibrator 145. Preferably, the gearboxes 144 are right angle gear boxes with Output shafts 152 driven by axle 148 and driving the succeeding portion of axle 148.

Preferably, hydraulic motors 146 rotate at approximately 2800–3800 rpm's. Thus, output shaft 152 turns the internal drive shaft of each vibrator 145 at a corresponding rate. The preferred pendulous vibrators used in system 25 are manufactured by Iskco, Ltd., located in North Little Rock, Ark. The internal pendulous of these vibrators strike the vibrator tip 145A three times for every input revolution to effectively triple the vibrator revolutions produced by the vibrator 145. In other words, an input of 3600 rpm's produces an effective vibratory rate of 10,800 rpm's. Thus, as a result of this tripling effect, our system 25 can employ a twenty horsepower engine to drive 16 pendulous vibrators requiring three quarter horsepower apiece and the other associated machinery without supplemental power being required.

Furthermore, in the preferred embodiment, each pendulous vibrator 145 quick couples to a power transferor 150 affixed to each gearbox output shaft 152. A quick-coupling end 145B inserts into a conventional ball detent coupler in transferor end 154. Of course, other configurations with differing numbers of motors, axles, gearboxes and pendulous vibrators are possible and intended to be within the scope of this disclosure.

OPERATION

The vibration system 25 is used to finish plastic concrete 42 adjacent the front of the truss 30. The system 25 preferably uses multiple pendulous vibrators 145 to vibrate the concrete 42 to consolidate and densify it.

Figure 7:
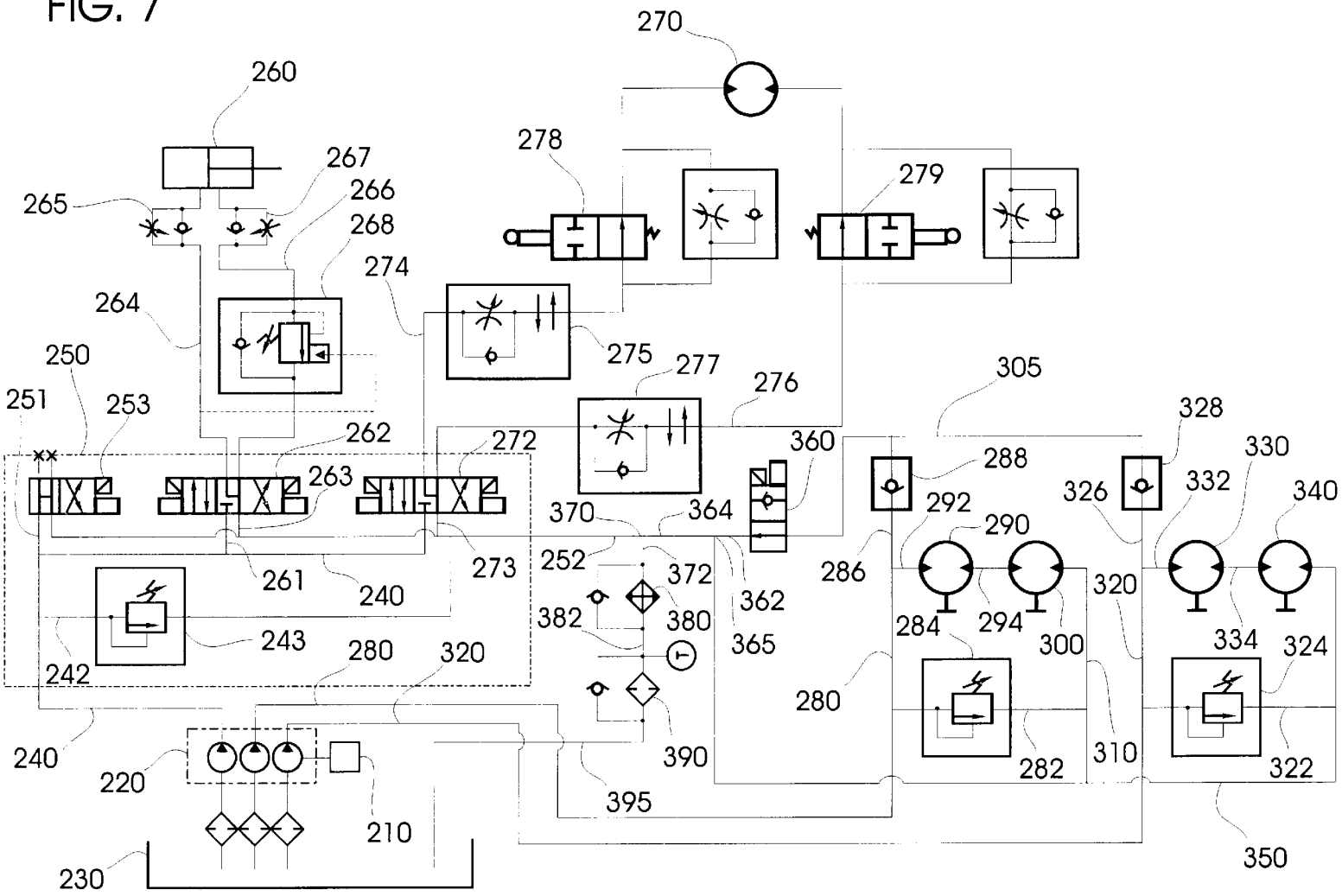
FIG. 7 is a schematic diagram showing the hydraulic system of the invention.
Figure 8:
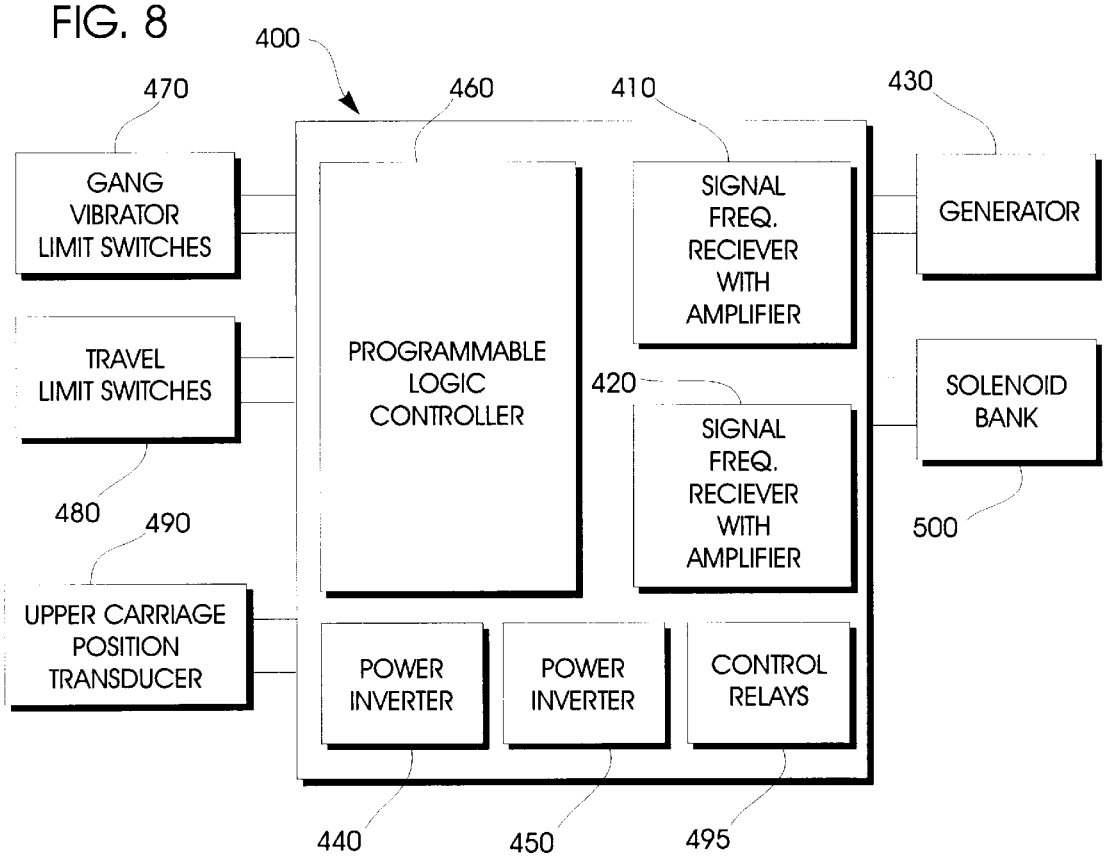
FIG. 8 is a block diagram of the preferred control system for the invention; and, FIG. 9 is a block diagram of the preferred transmitter
Figure 9:
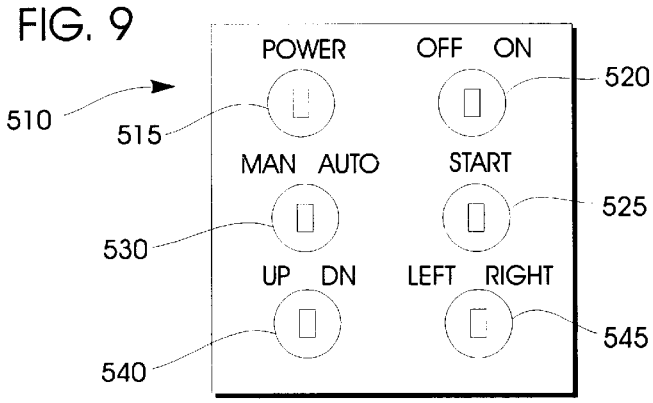

In use, the engine 92 powers system 25 by driving a hydraulic pump 104 that provides pressurized fluids to the motor 78 and vibration assembly 110 to energize the system 25. Used fluids are cooled by an air-to-liquid heat exchanger 94. The schematic for the hydraulic routing and controls is seen in FIG. 7.

Preferably, all internal combustion engine 210 turns the adjacent triple pump 220 at a rate in the range of 2800 to 3800 rpm's. The associated reservoir 230 provides sufficient fluids to ensure proper pump operation and output into lines 240, 280 and 320 (preferably at a rate of 4.2, 8 and 8 rpm respectively).

Output line 240 supplies a manifold 250 that controls the hydraulic lift cylinder 260 and propulsion motor 270. After line 240 enters manifold 250, a safety line 242 branches therefrom and proceeds to a safety relief valve 243 and thence to the manifold return line 252. The output line 240 also branches again into lines 251 to unload valve 253 and supply line 261 for the cylinder before terminating at supply line 274 for the propulsion motor 270.

Supply line 261 flows to a directional solenoid valve 262 that controls lift cylinder 260. If the cylinder is to extend, fluids flow under pressure through line 264 to cylinder 260 through flow control valve 265 while fluids leave cylinder 260 through line 266 through flow control valve 267. The process reverses when the cylinder retracts. A holding valve 268 maintains cylinder position when there is no flow. Solenoid exit line 263 permits fluid flow from solenoid 262 into manifold exit line 252.

Supply line 274 flows to a directional solenoid valve 272 that controls motor 270. If the motor is to move the carriage in one direction, fluids flow under pressure through line 274 and pressure compensated flow control valve 275 to motor 270 while fluids leave motor 270 through line 276 and pressure compensated flow control valve 277. Hydraulic cam valves 278, 279 control fluid flow to motor 270 to control acceleration and deceleration. Fluid flow is reversed to move the carriage oppositely. Solenoid exit line 273 permits fluid flow from solenoid 272 into manifold exit line 252.

Output lines 280 and 320 supply the gang vibrator motors 290, 300 and 330, 340 respectively. Line 280 branches into lines 282 running through relief valve 284 and line 286 running through check valve 288. Line 280 terminates at line 292, the supply line for motor 290. Fluids exit motor 290 via line 294 and enter motor 300. Fluids exit motor 300 via exit line 310. When the motors 290 and 300 are off, fluids exit via check valve 288 and line 286. Line 286 intersects return line 305. Fluids in line 305 are routed through solenoid 360, as discussed hereinafter. Exit line 310 intersects exit line 350.

Line 320 branches into lines 322 running through relief valve 324 and line 326 running through check valve 328. Line 320 terminates at line 332, the supply line for motor 330. Fluids exit motor 330 via line 334 and enter motor 340. Fluids exit motor 340 via exit line 350. When the motors 330 and 340 are off, fluids exit via check valve 328 and line 326. Line 326 intersects return line 305. Exit line 310 intersects exit return line 350.

When solenoid 360 is open, motors 290, 300, 330 and 340 turn at low idle speed and fluids flow through check valves 288 and 328 and line 305 through the solenoid 360 and back to reservoir 230. When solenoid 360 is closed, fluids are forced through motors 290, 300, 330 and 340 to make them turn and then back to reservoir 230.

Solenoid Output line 362 is intersected by motor output line 350 at junction 365 to form motor return line 3)64. Line 364 intersects manifold Output line 252 at intersection 370 to form a system return line 372. Line 372 flows into an air-to-liquid heat exchange 380. The exchanger 380 is cycled on and off based on the temperature setting on oil temperature sensor "T". Output fluids in line 382 from exchanger 380 then flow through filter 390 before entering reservoir return line 395.

The gasoline engine driven generator 96 provides electrical power for the control panel 100. Preferably, control panel 100 accepts radio input to control the flow of hydraulic fluid throughout system 25 to facilitate remote operator manipulation of system 25. A frequency band radio transmitter and frequency band radio receiver are known to work effectively in system 25.

The control panel 100 houses an internal back panel 400. Panel 400 mounts two signal frequency receivers 410, 420 with amplifiers to receive the control transmiissions. The control panel 100 is powered by the generator (represented by box 430) that supplies 120 V AC that is converted by two power inverters 440, 450 into 12 V DC and 24 V DC respectively. Receivers 410, 420 require 12 V while the other components require 24 V.

A programmable controller 460 accepts system input from the gang vibrator limit switches (represented by box 470), the travel limit switches (represented by box 480) and the rotary transducer (represented by box 490). The controller 460 interprets this data and correspondingly directs a solenoid bank 500 via relays 495 to control the vibration assembly 110 and the drive motor 78.

The system 25 nay operate in either a manual or an automatic mode. The radio transmitter 510 employs several switches to direct panel 100. A power light 515 indicates power to transmitter 510. A master on/off switch 520 controls the power to transmitter 510. Start button 525 initiates the automatic sequence for the grid pattern.

System 25 may operate in either an automatic or a manual mode. The manual/auto switch 530 determines the operational mode of the system 25. When in automatic mode, the system 25 will consolidate and densify concrete without operator intervention, as is to be more fully discussed hereinafter. When in manual mode, system 25 is directed by an operator manipulating up/down switch 540 and left/right switch 545. The up/down switch controls the vertical displacement of vibration assembly 110 while the left/right switch 545 controls the positioning of carriage 70 on truss 30.

When deploying the pendulous vibrators 145 as indicated by arrow 111B (FIG. 1) in both the manual and automatic modes, the bottom pendulous vibratory portion of each pendulous vibrator is thrust into the concrete 42. When at a suitable depth, vibration begins and continues for a predetermined time period until the concrete is suitably densified and consolidated.

Preferably, the pendulous vibrators 145 are arranged in two rows on one foot square centers. In other words, the pendulous vibrators 145 are one foot apart from each other front-to-back and side-to-side. Moreover, the back row of pendulous vibrators are preferably one foot in front of the paver 38. However, more than two rows of pendulous vibrators could be employed if desired. Of course, the offset area 95 would require alteration to address any additional torsion caused by an expansion of the vibration assembly 110.

When a sector of concrete 42 has been vibrated, the pendulous vibrators 145 are retracted as indicated by arrow 111A (FIG. 1) and the carriage 70 moved to an adjacent sector of concrete to be vibrated (as indicated by arrows 46 or 47 in FIG. 1). When the carriage has completely traversed the truss 30 from end 31A to end 31B, the truss 30 is moved longitudinally along tubes 36 to begin work upon a new length of concrete.

In the automatic mode, the programmable controller 460 directs system 25 with minimal operator supervision. The system begins in the "home" position adjacent one of the stanchions 34. The controller then activates the vibration assembly 110 and plunges pendulous vibrators 145 into the plastic concrete 42 via elevator 120 until reaching the lower limit switch 132. After the pendulous vibrators vibrate the concrete 42 for a preselected period of time, they cease vibrating and they are raised via elevator 120 until reaching the upper limit switch 130.

The carriage 70 then moves via motor 78 until rotary transducer 81 reports travel sufficient to advance the entire vibration assembly to an adjacent, unvibrated sector of concrete. The pendulous vibrators 145 are again lowered and the unvibrated concrete is vibrated. The sequence is repeated until the carriage limit switches 77 trip on brackets 65. Then, the truss 30 advances along tubes 36 and the entire process is repeated in the opposite direction lengthwise across truss 30.

One important consideration the control panel 100 addresses in its automatic mode is the alternate operation of motor 78 and pendulous vibrators 145. In other words, when the carriage 70 is moving, the pendulous vibrators 145 must be in the retracted position where they do not vibrate. Conversely, when the pendulous vibrators 145 are vibrating concrete 42, motor 78 must be disengaged so that the carriage 70 does not move and drag the pendulous vibrators laterally through the concrete 42.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An outboard vibration system for bridge decks of the type comprising an elongated truss spanning plastic concrete, said system comprising:

gang vibrator means for densifying and consolidating plastic concrete therebelow, said gang vibrator means comprising, a subframe vertically suspending a plurality of individual vibrators arranged in spaced-apart columns and rows, drive axle means for driving each row, and right angle gear means for coupling vibrators in a given row to said drive axle means;

elevator means for supporting said gang vibrator means a predetermined distance above said concrete, said elevator comprising a protruding receiver with a plurality of spaced apart mounting holes;

mobile carriage means coupled to said elevator means for controlling said gang vibrator means, said carriage means comprising power means for energizing said system;

rail means coextensive with the length of said truss for mounting said carriage means for lengthwise movement across the top of said bridge deck;

wherein said carriage means is offset from a side of said rail means on a side opposite that of the gang vibrator means to counterbalance said gang vibrator means;

means for controlling said carriage means to advance said gang vibrator means through concrete; and, yoke means coupled to said receiver means for adjustably suspending said elevator means at a desired height, said yoke means comprising a plurality of spaced apart orifices adapted to register with orifices in said receiver.

2. The system as defined in claim 1 wherein:

said rail means comprises a pair of spaced apart rails secured to the top of said truss extending between opposite truss ends, each of said rails comprising an internal channel;

said system comprises elongated chain means secured within and coextensive with said channel; and, said carriage means comprises drive pinion means emanating from said carriage means and entrained with said chain means within each rail.

3. A self-balancing, outboard vibration system for bridge decks of the type comprising an elongated truss spanning plastic concrete, said truss having a front and a back, and said system comprising:

gang vibrator means for densifying and consolidating plastic concrete therebelow, said gang vibrator means comprising a subframe vertically suspending a plurality of individual pendulous vibrators arranged in spaced-apart columns and rows, drive axle means for driving each row, and right angle gear means for coupling vibrators in a given row to said drive axle means;

elevator means for supporting said gang vibrator means a predetermined distance above said concrete, said elevator comprising a protruding receiver with a plurality of spaced apart mounting holes;

mobile carriage means coupled to said elevator means for controlling said gang vibrator means, said carriage means comprising motor means for powering said system;

rail means coextensive with the length of said truss for mounting said carriage means for lengthwise movement across the top of said bridge deck, said rail means comprising a pair of spaced apart rails secured to the top of said truss and extending between opposite truss ends, each of said rails comprising, an internal channel;

wherein said system comprises elongated chain means secured within and coextensive with said channels and said carriage means comprises drive pinion means emanating from said carriage means and entrained with said chain means within each rail, said pinion means driven by said motor means;

wherein said carriage means is offset from a side of said rail means on a side opposite that of the gang vibrator means to counterbalance said gang vibrator means;

operator means for remotely controlling said carriage means to advance said gang vibrator means through concrete; and, yoke means coupled to said receiver means for adjustably suspending said elevator means at a desired height, said yoke means comprising a plurality of spaced apart orifices adapted to register with orifices in said receiver.

* * * * *